US006321455B1

(12) United States Patent
Burchell

(10) Patent No.: US 6,321,455 B1
(45) Date of Patent: Nov. 27, 2001

(54) WINDSHIELD REMOVER KNIFE AND METHOD

(76) Inventor: Christopher S. Burchell, 35 Poplar Grove Ter., West Milford, NJ (US) 07480

( * ) Notice: Subject to any disclaimer, the term of this patent is extended or adjusted under 35 U.S.C. 154(b) by 0 days.

(21) Appl. No.: 09/200,536

(22) Filed: Nov. 25, 1998

(51) Int. Cl.[7] ..... B26B 1/00
(52) U.S. Cl. ..... 30/321; 30/340; 7/100
(58) Field of Search ..... 30/339, 340, 321, 30/155, 329; 7/100

(56) References Cited

U.S. PATENT DOCUMENTS 4,730,394 * 3/1988 Sonner, Jr. ..... 30/161
5,400,512 * 3/1995 Brush ..... 30/321
5,673,487 * 10/1997 Malagnoux ..... 30/179

FOREIGN PATENT DOCUMENTS

136047 * 4/1919 (GB) .

* cited by examiner

*Primary Examiner*—Lee Young
(74) *Attorney, Agent, or Firm*—W. Patrick Quast, Esq.

(57) ABSTRACT

A windshield remover knife is described. The knife is principally comprised of a straight, elongated shaft having a pivotal neck portion securing a cutting blade for cutting through the adhesive, elastomeric bond holding the windshield in place. When the shaft is held by an operator in a horizontal position, the neck portion can be secured in the same identical plane as the shaft with the cutting edge of the blade facing downward. In this horizontal position, the neck portion can also be pivoted and secured in pivotal alignment to the left or right of this plane of the shaft at any angle up to 90°. In this manner the neck portion of the knife can be configured to even extreme windshield curvatures while maintaining the shaft portion in a comfortable position for rapid and efficient cutting of the adhesive bond.

8 Claims, 5 Drawing Sheets

WINDSHIELD REMOVER KNIFE AND METHOD

BACKGROUND

This invention relates to methods and devices for removing the windshield from an automobile, and in particular to a hand held device for effectively cutting the sealant employed to secure the windshield in place.

In current automobile manufacturing practice the windshield is affixed to the automobile by being placed between the interior body portion of the automobile and an exterior molding, with a tough, reliable sealant, usually a urethane formulation, adhesively securing the windshield in place. To remove a windshield from an automobile, which is necessary when a windshield has been damaged or is to be recovered as salvage, this tough sealant material must be efficiently cut through to effect a clean removal of the windshield from the vehicle. To compound the problem of windshield removal, since 1990 the aerodynamic design of most vehicles has increased the curvature of the body of the automobile, including the area into which the windshield is affixed. In a number of late model automobiles the windshield actually wraps around the bottom side of the pillar posts.

Many methods and devices have been suggested in the past to aid in this vexing problem of windshield removal as is evident from the patent literature. For example, in U.S. Pat. No. 5,622,093, issued Apr. 22, 1997, a suction cup assembly 12 (FIG. 5) is affixed to the interior of a windshield with an attached cutting wire 18 (FIG. 5) being threaded through the windshield seal, the wire then being manipulated in a reciprocal motion so as to cut through the seal. Again, in U.S. Pat. No. 4,995,153, issued Feb. 26, 1991, two wire end gripping devices 14 (FIG. 1) are described for securing the ends of a cutting wire 12 (FIG. 1) being utilized to cut through the seal securing a windshield to an automobile frame.

Cutting knives attached to power sources have also been employed as is evident from U.S. Pat. No. 4,955,124, issued Sep. 11, 1990. This patent teaches the use of a cutting blade 18 attached to a slightly curved rigid sheath 24, which in turn is connected to a source of power 12 (FIG. 1), such as a portable jig saw. In this manner the cutting blade contacts the polyurethane seal and severs the seal without breaking the windshield. Another potentially power driven cutting knife is described in U.S. Pat. No. 4,395,825, issued Aug. 2, 1983. This patent teaches the use of an elongated, flexible blade 1 (FIG. 1) secured within a holder 2, said holder being adapted for either gripping with a handle 15 or with a hammer stem 8 being connected to a reciprocating power tool 18 (FIG. 4). In this manner the blade is used to cut the elastomeric strip bonding the windshield to the vehicle.

Hand held devices are, of course, commonly employed in windshield removal applications as is evident by U.S. Pat. No. 4,694,576, issued Sep. 22, 1987. This patent teaches the use of a U shaped blade 16 (FIG. 3) attached to an elongated shaft 14 with a handle 12 to facilitate the removal of excess urethane sealant from the outer edges of an automobile windshield. Again, in U.S. Pat. No. 5,400,512, issued Mar. 28, 1995, a trapezoidal cutting blade 30 (FIG. 2) is secured within a head portion 20 (FIG. 1) attached to a neck 50 and body portion 12 of a generally tubular shaft. The neck portion is extendable from the body portion, and the cutting blade is pivotable up and down in the direction of the plane in which the body portion if being held. The device is intended for removing windshield molding from a vehicle.

While the above noted devices and methods provide useful means for vehicle windshield removal, they do not envisage the economy in fabrication and the simplicity of operation of the present invention.

It is therefore a primary object of the present invention to provide a new and improved knife for procedures involving removing a windshield from a vehicle.

An additional object of the present invention is to provide a knife to be employed in vehicle windshield removal that is economical to manufacture.

A further object of the present invention is to provide a knife to be employed in vehicle windshield removal wherein the knife blade is replaceable and the cutting surface of the blade is length adjustable.

Another object of the invention is to provide a pivotable cutting blade for rapid and efficient cutting of the adhesive bond between the frame of a vehicle and a curved windshield.

SUMMARY

These and other objects are obtained by the windshield remover knife and method of the present invention.

As noted above, cutting through the tough, adhesive bond between a windshield and other glass windows within a vehicle has traditionally been a time consuming and vexing procedure for the automobile mechanic. Understandably automobile manufacturers are primarily concerned with the structural integrity of the vehicle, particularly as it concerns a roll over or frontal collision. This remains true even as style dictates ever more curved windshields for both domestic and foreign automobiles.

A standard windshield removal operation in the past comprised three steps. A first step involved removing the existing molding. The second step is to cut out the top and sides of the adhesive bonding between the windshield and the automobile frame, usually employing what is known as a "cold knife". The third step involved using what is known as a "long knife". The procedure is to get inside the vehicle with the mechanic then using his or her head to press against the windshield, raising the windshield just enough to start cutting the bottom corners.

As can be imagined from the above description this procedure left much to be desired, and especially so with the newer, highly curved windshield designs. It occurred that in this third step if the knife blade could be pivoted at just the right angle relative to the shaft holding the blade the procedure could be done comfortably for the mechanic, and in a fraction of the time previously required.

This thought process has led to the development of the windshield remover knife of the present invention. A knife has been devised comprising an elongated, rectangularly shaped box like shaft attached to a pivotally connected neck portion in which a trapezoidally shaped, commercially available knife blade is secured. The neck portion has a removable block portion, which, when removed, creates a slot for the insertion of the blade into the neck portion. The trapezoidally shaped blade has a sharpened bottom edge, and a top edge containing two notches a spaced distance apart. When the blade is positioned in the slot within the neck portion, the block portion then fits into the slot. A hole in the neck portion matches a threaded hole in the block portion enabling a screw to firmly secure the neck portion, blade, and block portion together. A second hole through the neck portion and block portion permits the placement of a locking pin in one of the two notches in the top edge of the blade so that a greater or lesser amount of the cutting edge of the blade is exposed beyond the neck portion for actual cutting operations.

The neck portion and shaft portion of the knife are pivotally connected together at one end of the shaft and the end of the neck portion opposite the tip of the exposed cutting edge portion of the blade. The union of the shaft and the neck portion can be effected by means of two projections on the face portion of this end of the shaft, with the neck portion end face having two matching slots to receive the two shaft end projections. The two shaft end projections have virtually the same O.D. as the I.D. of the slots so that a tight, frictional fit is secured when the end projections are placed within the slots. Vertically aligned, matching holes in the two shaft end projections match up with a hole in each of the upper shelves above each of the two slots in the neck portion end face. An aligning pin can now be placed in the matching shelves and projection holes which now secures the neck portion and shaft portion of the knife securely together. Depending on the built in gap between the face portion of the slots and the face portion of the end of the shaft extending at right angles to the projections, an operator can now manually (or with the assistance of a vice by securing the neck portion of the knife within a vice) adjust the position of the neck portion of the knife relative to the shaft portion from 0° to 90° to the left, or 0° to 90° to the right of the plane of the shaft when the shaft is held in a horizontal position with the cutting edge of the blade facing downward.

To operate the windshield remover knife of the invention, the aligning pin is inserted through the matching holes in the shaft end projections and the neck shelves when the neck and shaft portions of the knife are pushed together, with the ends of the aligning pin being peened over to firmly secure the neck and shaft together at an aligned pivot point. The neck is then bent to contour to the bottom corner of each different application, and the adhesive bond is easily and rapidly severed. Other difficult areas, such as near the top of the windshield when standard long knives will not go easily past the rear view mirror, are now conveniently accessible. As mentioned above the portion of the cutting surface of the blade exposed beyond the neck portion can be increased or decreased depending on the position of the notches on the top edge of the blade within the neck portion when the pin locking the blade in position is inserted. After a period of use the blade is easily replaced with a new blade as may be required. The shaft and neck portions of the knife can be fabricated in a variety of suitable materials, such as aluminum, steel, or a rigid plastic material. The shaft and neck portion of the knife are similarly rectangular in shape for presenting a solid gripping surface to an operator. Other shapes, such as a tubular shape for the shaft portion of the knife, can also be employed.

Thus it can be seen the windshield remover knife of the present invention provides a simple, economical solution to the problems encountered in removing curved windshields from vehicles. The unique pivoting action of the neck portion of the blade now permits convenient blade insertion of a rigid, high resistance cutting blade into adhesive bond areas securing a windshield to a vehicle, and convenient manipulation of the blade with a rigid shaft now positioned at a comfortable cutting angle relative to the position of the blade than was heretofore possible.

DETAILED DESCRIPTION

Figure 1:
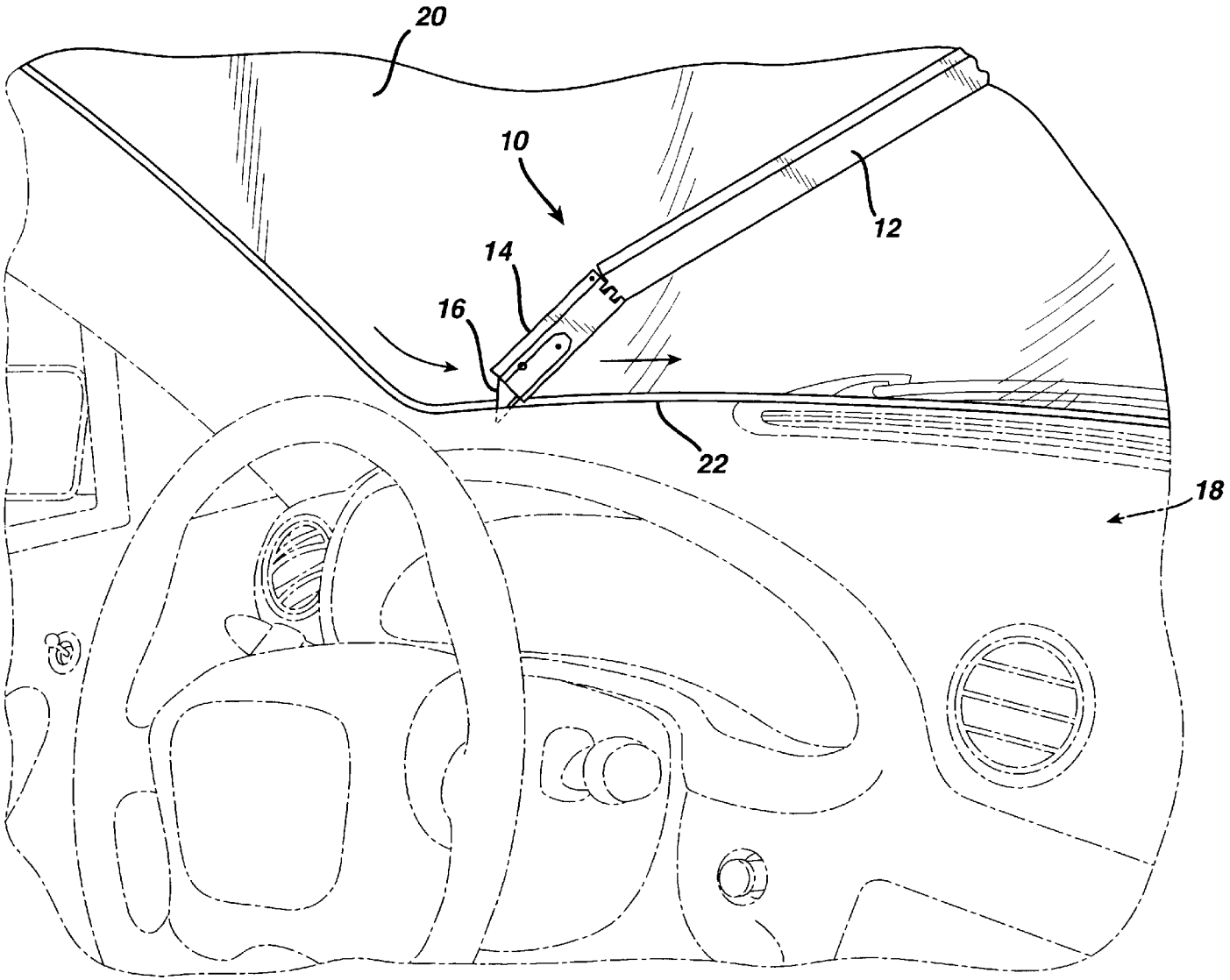
FIG. 1 is a perspective view from the interior of a vehicle of one version of the windshield remover knife of the invention in the act of cutting the adhesive bond between the windshield and the frame of the vehicle.

Turning now to the drawings, in FIG. 1 a version of the windshield remover knife 10 of the invention is depicted. The knife 10 consists essentially of a rigid shaft 12 and a pivotally connected neck portion 14 providing a housing for the projecting cutting blade 16. Typical dimensions would be 14½" in length for the shaft portion, 2¾" in length for the neck portion, and for both portions a width of ¼" and a height of 1 ". The knife 10 is shown as being operated within the interior area 18 of an automobile. The blade 16 is shown as being inserted between the frame 22 of the automobile and windshield 20.

Figure 2:
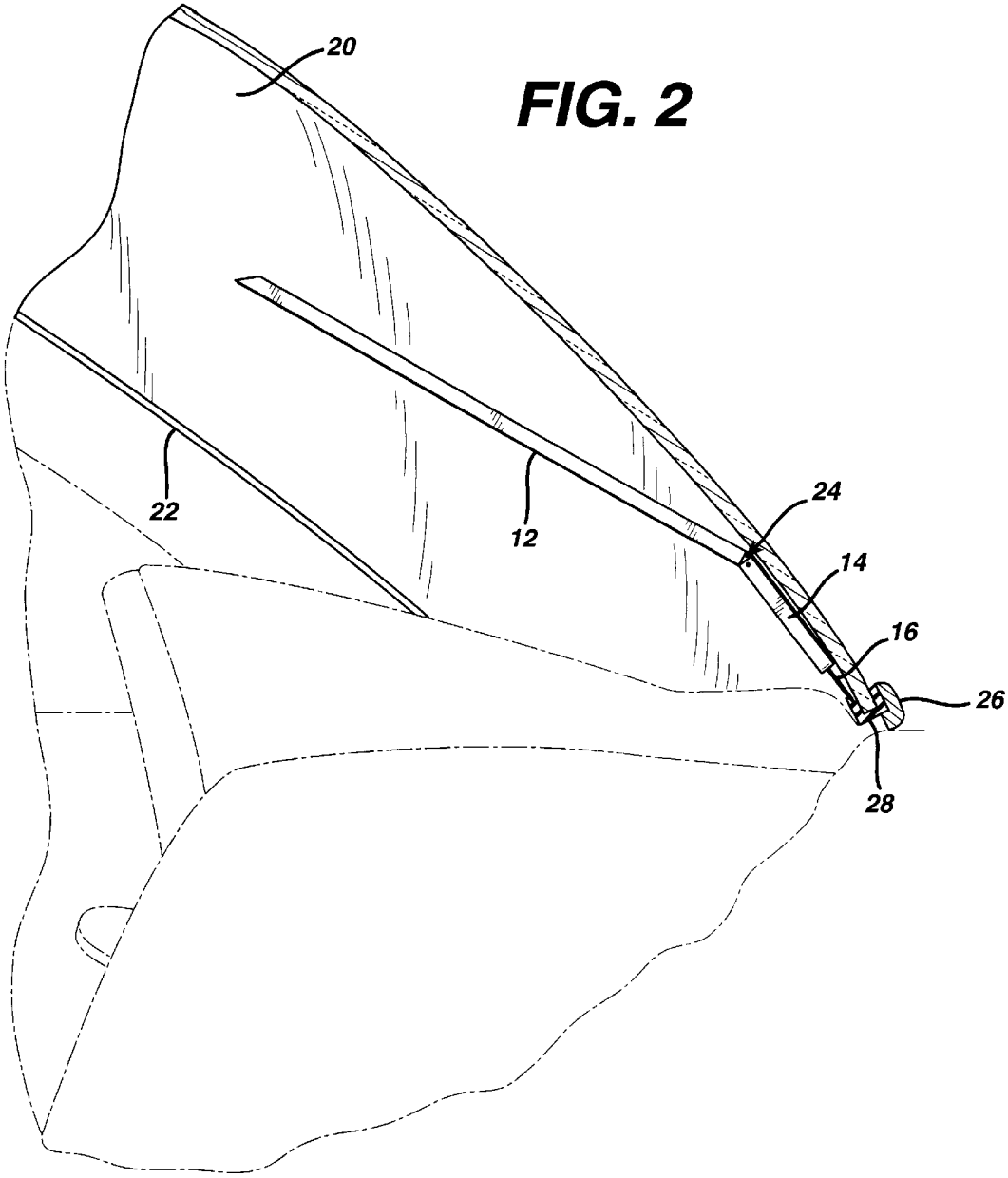
FIG. 2 is a partially sectional, side elevational view of one version of the windshield remover knife of the invention illustrating the cutting blade conforming to the curvature of the windshield while the knife shaft remains free for manual manipulation.
Figure 3:
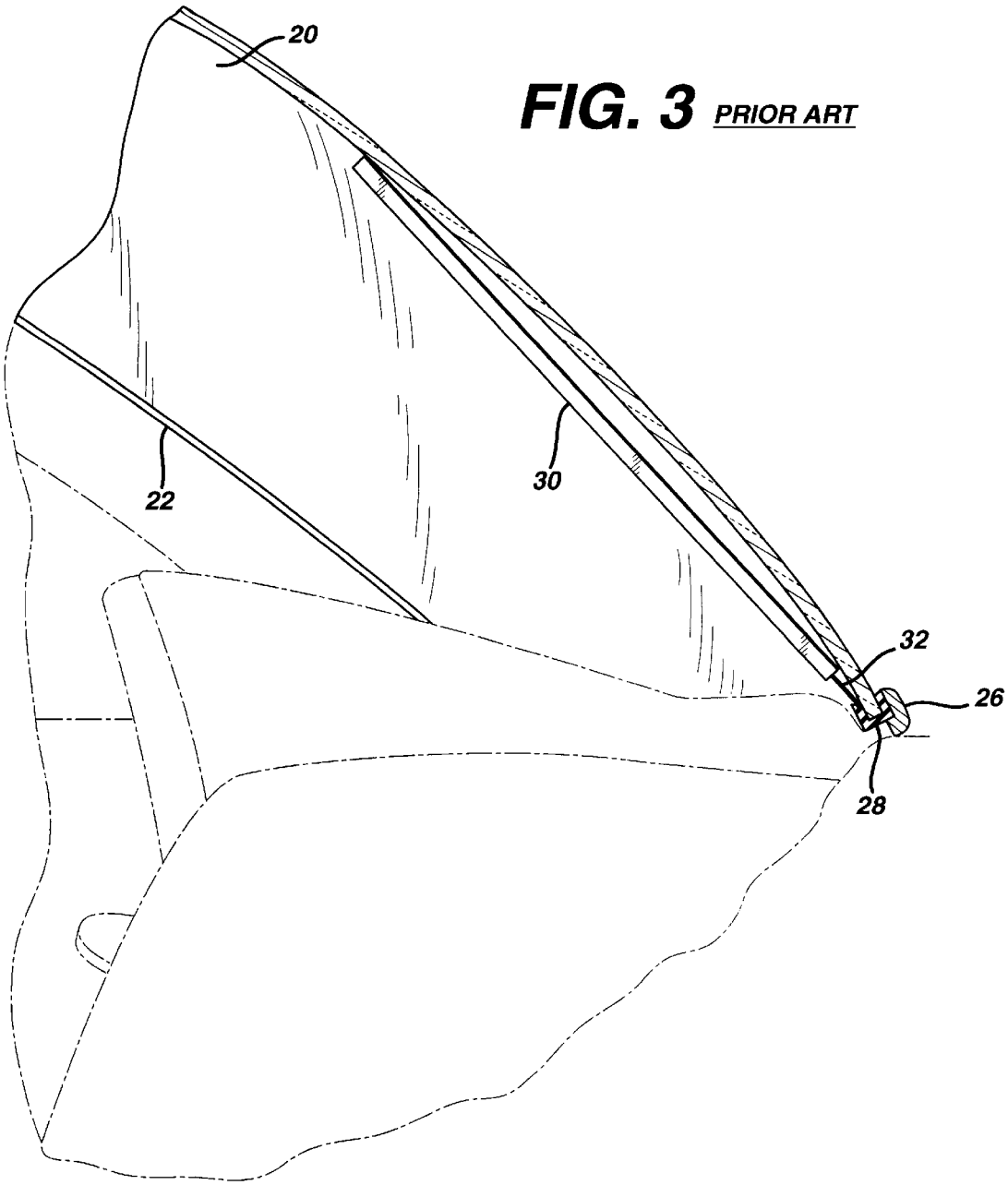
FIG. 3 PRIOR ART
FIG. 3 is a view similar to that of FIG. 2 illustrating problems in windshield removal encountered with knives of the prior art.

As best seen in FIGS. 2 and 3, the neck portion 14 can be pivoted away from the connecting shaft portion 12 of the knife 10. FIG. 3 illustrates a prior art version of a similar knife comprised of an elongated shaft 30 and attached blade 32. As depicted in FIG. 3, using a standard, prior art long knife to cut through the tough, urethane adhesive bond 28 between the frame 22 and the molding 26 of the automobile in order to free, and therefore remove the windshield, is a difficult, time consuming, and irritating procedure. This, of course, is especially true when dealing with a highly curved windshield 20 as shown in FIGS. 2 and 3. In sharp contrast, the knife of the invention 10 performs this operation comfortably and quickly. The operator can adjust the neck 14 of the knife 10 at the pivot point 24 so as to accommodate the curved portion of the windshield, with the shaft portion 12 of the knife positioned at a desirable angle away from the windshield. Except for some minor flexibility on the part of the blade itself, the remainder of the knife is maintained in a rigid configuration for comfortably yet effectively applying the considerable cutting action required for these tough, elastomeric seals.

Figure 4:
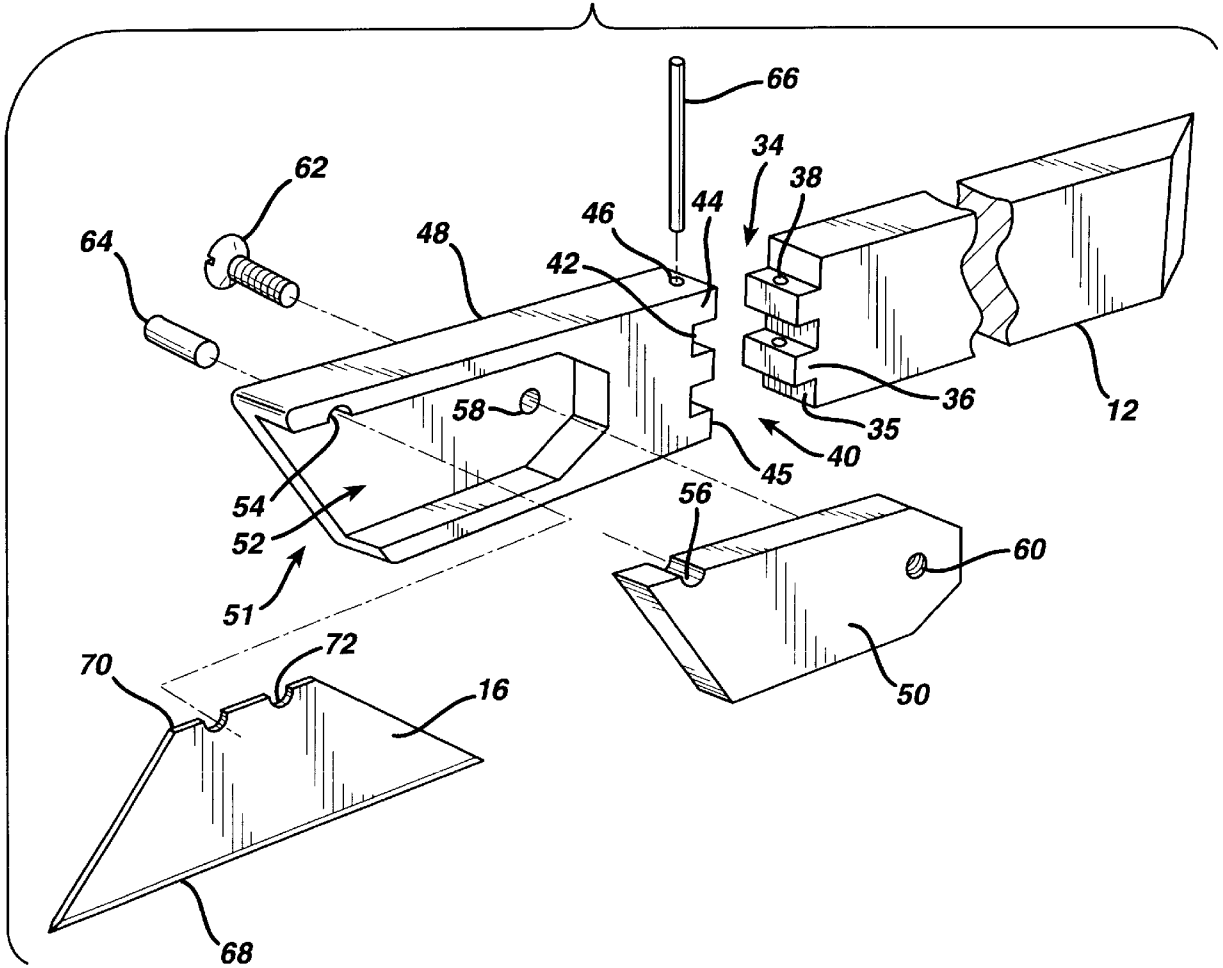
FIG. 4 is an exploded view of one version of the neck portion, blade, and shaft of the windshield remover knife of the invention, illustrating the pivotal connection between the neck portion and the shaft, and the means for positioning, connecting, or removing knife blades.

A detailed version of one means for having the neck portion 14 pivot in relation to the shaft 12 of the knife is illustrated in FIG. 4. The neck connecting face 34 on the shaft has two rectangularly shaped projections 36 extending linearly away from the shaft end portion 34. The shaft connecting end portion 40 of the neck has two matching slots 42 for receiving the two shaft projections 36. A shelf portion 44 in the shaft connecting end portion 40 above and below each slot 42 define each of the two slots. A centrally positioned hole 38 in each of the projections 36 align with a centrally positioned hole 46 in each of the shelves. The O.D. of the projections and the I.D. of the slots are virtually the same so that when the projections 36 are placed within their matching slots 42 a secure frictional fit is obtained between the neck and the shaft. The aligning pin 66 (which in this example can be a 1" long ×¼" wide hardened steel pin) is now inserted within the matching shelf holes 46 and projection holes 38, the ends of the aligning pin now being peened over so as to firmly secure and pivotally align the neck and shaft about this pivot point 24.

Figure 5:
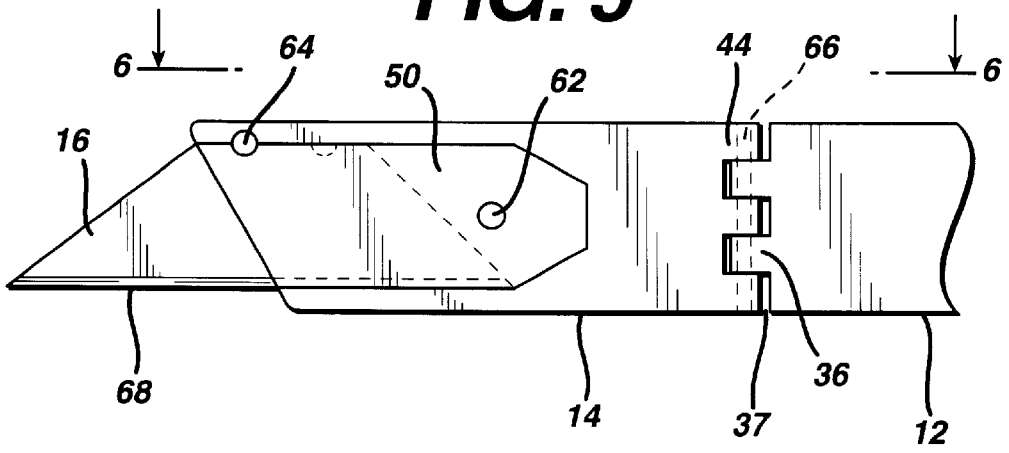
FIG. 5 is a side elevational, partially sectional illustration of the neck portion and shaft portion of one version of the knife of the invention positioned in horizontal alignment.
Figure 6:
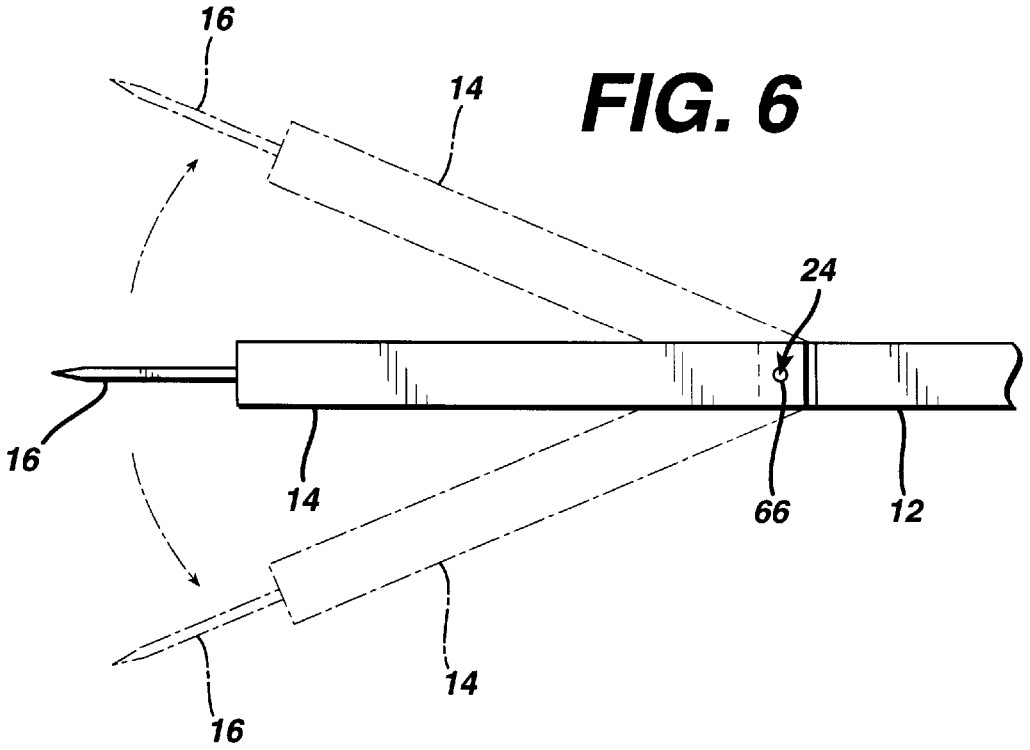
FIG. 6 is a top plan view, taken along the line 6—6 of FIG. 5, of the neck and shaft portion of one version of the knife of the invention, illustrating the pivotal connection of the neck and shaft portions of the knife shown in phantom.

The frictional fit between the neck slots 42 and the shaft projections 36 permits a degree of motion either to the left or right away from the horizontal plane of the shaft 12 when the shaft is held in a horizontal position by an operator with the cutting edge of the blade facing downward, as seen in FIG. 6. For example, with a ¼" overlap between the slots 42 and the projections 36, and with a 1/16" gap 37 (FIG. 5) between the face portion 45 of the shelves and the face portion 35 of the neck connecting end portion of the shaft 34 positioned at right angles to the shaft projections, an operator can pivot the neck up to 20° to the left or right of this plane as depicted in FIG. 6. It is important that this adjustment require a degree of substantial force so that, once adjusted, the angle between the neck and shaft remain at the degree selected by the operator during the procedures involved in windshield removal. To facilitate adjusting a selected angle, the neck portion of the knife can be secured in a vice, and then the shaft and neck pivoted by the operator to a selected angle. By increasing the above noted gap 37 between the shelf face portion 45 and the face portion of the neck connecting end of the shaft 35, knives can be provided with different potential degrees of pivot from a horizontal plane, as, for example, up to 40° left or right, or up to 90° left or right. Obviously, a variety of other structures can be employed to pivot the neck portion 14 in the described manner, such as, for example, a hinge positioned between the neck portion 14 and the shaft portion 12.

FIG. 4 also shows details of one version for securing a cutting blade 16 within the pivotable neck portion. In this design the neck portion is comprised of two main components, a blade holder 48 and a block 50. Assuming in this example that the complete knife assembly is fabricated from ¼"×1" aluminum stock (such as a commercially available aluminum stock no. 6061-T6) with the shaft portion measuring 14½" in length, the blade holder 48 would measure 2¾" in length ×1" in width, and the block would measure ¾" in width ×2" in length. The blade holder 48 has the above described shaft connecting face at one end, and at its other end it contains a cut out portion 52 exactly matching the outer dimensions of the block 50. The front entrance 51 to the cut out portion slants diagonally from a base portion of the cut out portion to the top of the cut out portion so that when a blade 16 is positioned between the blade holder 48 and the block 50, a length of the cutting edge 68 of the blade facing downward from the top of the cut-out portion is exposed for the function of adhesive bond 28 cutting. The suggested commercially available blade 16 employed has a trapezoidal shape, with a sharpened bottom edge 68 for cutting purposes, and a top edge 70 having two semi-circular convex cut-outs 72 a spaced distance apart. These two blade cut-outs 72 match a semi-circular concave cut-out 54 in the blade holder 48 adjacent the opening 51 to the cut-out portion 52 of the blade holder. When the blade 16 is secured within the block securing cut-out portion of the blade holder 48, and the block 50 is positioned in place within the holder, a block convex matching cut-out, matching the first blade cut-out 72 with the blade holder semi-circular concave cut-out, and securing this blade position with a blade securing roll pin 64 (which can be a steel pin measuring ⅛"×¾") being inserted into the hole created by the matching semi-circular cut-outs 54, 72, and 56 provides for maximum exposure of the cutting edge 68 of the blade 16. Similarly positioning the roll pin 64 through the second semi-circular convex cut-out 72 in the top edge 70 of the blade permits locking the blade with a minimum exposure of the cutting edge of the blade. With the blade 16 positioned within the blade holder block cut out portion 52, the block 50 in position within the holder 48, and the blade securing roll pin 64 in position, the block 50 and blade holder 48 are secured together by a screw 62 passing through a hole 58 in the blade holder and a threaded hole 60 in the block 50.

A variety of cutting blades can be employed in place of the trapezoidally shaped blade described above, such as for example, razor blades. Obviously a number of other structures can serve the purpose of providing an easily replaceable and cutting length adjustable cutting blade. The shaft portion and neck portion of the knife are preferably fabricated in a rigid metal, such as aluminum or steel, or a suitable rigid plastic material.

While versions of the present invention have been shown in detail, various modifications and improvements thereon will become rapidly apparent to those skilled in the art. Accordingly, the spirit and scope of the present invention is to be limited only by the following claims.

What is claimed is:

1. A windshield remover knife for cutting the adhesive bond securing said windshield to a vehicle, comprising:

(b) a straight, elongated rigid shaft portion disposed in a first plane;

(b) a straight, rigid neck portion being shorter in length than said shaft portion said neck portion having means for securing a blade within said neck portion so that a length of a cutting edge on said blade extends forward of said neck portion for cutting said adhesive bond, said blade including said cutting edge disposed in a second plane; and, (c) said shaft portion and said neck portion being connected by means for pivoting said neck portion relative to said shaft portion;

said pivoting means for connecting said neck portion to said shaft portion adapted to permit said second plane containing said blade including said cutting edge to be coplanar with said first plane containing said shaft portion in a first position and adapted to permit the lateral movement of said shaft portion relative to said neck portion, such that said first plane containing said shaft portion may be displaced from said position, laterally to the left or right of said second plane containing said blade including said cutting edge, such that said second plane is no longer coplanar with said first plane, thereby enabling an operator, utilizing said knife to cut said bond, to adjust said neck portion and therefore said cutting edge of said blade to a curved area of said windshield with said shaft portion extending laterally away from said curved area, wherein said pivoting means comprises at least one projection extending from a first end of said shaft portion and at least a matching slot within a first end of said neck portion, said at least one projection and said at least said matching slot cooperating to form a pivoting connection between said shaft portion and said neck portion when said at least one projection is secured within said at least said matching slot, wherein, said at least one projection and said at least said matching slot are dimensioned complementarily such that they are joined by a friction fit, whereby said at least one projection and said at least said matching slot cooperate to form a frictional, pivoting connection when said at least one projection is friction fitted within said at least said matching slot, and wherein said pivoting means further comprises an aligning pin, said at least one projection and said at least said matching slot having apertures therein, said apertures matching up co-axially when said at least one projection is secured within at least said matching slot, so that when said aligning pin is placed within said apertures said shaft portion and said neck portion are secured together in pivotal alignment.

2. The windshield remover knife according to claim 1 wherein said pivoting means is comprised of two projections extending from a first end of said shaft portion and two matching slots within a first end of said neck portion, said projections and said slots cooperating to form a pivotable connection between said shaft portion and said neck portion when said projections are secured within said slots.

3. The windshield remover knife according to claim 1 wherein said blade securing means is comprised of a blade holder having a cut-out aperture matching a block, said block being secured to said blade holder by a screw passing through matching openings for said screw within said blade holder and said block to form said blade securing means, said blade being positioned within said blade holder cut-out aperture with a portion of said blade extending forward of said block holder cut-out aperture prior to said block being secured to said blade holder.

4. The windshield removal knife according to claim 3 wherein said blade has a top edge opposite said cutting edge, said top edge having two convex semi-circular cut-outs a spaced distance apart, said blade cut-outs matching a concave semi-circular cut-out in said blade holder and a convex semi-circular cut-out in said block, so that depending on which of said two convex blade cut-outs match said concave cut-out in said holder and said convex cut-out in said block when said blade is secured in said blade holder and a position securing pin in placed through said semi-circular cut-outs in said holder, said blade, and said block, a lessor or greater length of said cutting edge of said blade extends forward of said neck portion.

5. The windshield removal knife according to claim 1 wherein said blade is trapezoidal in shape.

6. The windshield removal knife according to claim 1 wherein said blade is a razor blade.

7. The windshield removal knife according to claim 1 wherein said shaft portion and said neck portion are fabricated in metal.

8. The windshield removal knife according to claim 1 wherein said shaft portion and said neck portion are fabricated in a rigid plastic.

* * * * *